US007532844B2

(12) United States Patent
Tanaka

(10) Patent No.: US 7,532,844 B2
(45) Date of Patent: May 12, 2009

(54) PROCESS CARTRIDGE, IMAGE FORMING APPARATUS AND METHOD OF ASSEMBLING PROCESS CARTRIDGES

(75) Inventor: Hideaki Tanaka, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 98 days.

(21) Appl. No.: 11/598,720

(22) Filed: Nov. 14, 2006

(65) Prior Publication Data

US 2007/0258732 A1 Nov. 8, 2007

(30) Foreign Application Priority Data

May 8, 2006 (JP) ..... 2006-128916

(51) Int. Cl.
*G03G 15/08* (2006.01)
*G03G 21/18* (2006.01)

(52) U.S. Cl. ..... 399/254; 399/111; 399/258

(58) Field of Classification Search ..... 399/254, 399/256, 258, 260, 263, 111, 119, 120; 430/120.1
See application file for complete search history.

(56) References Cited

U.S. PATENT DOCUMENTS 4,056,076 A * 11/1977 Smith ..... 399/256
5,049,941 A * 9/1991 Manno et al. ..... 399/263
5,402,216 A * 3/1995 Komaki et al. ..... 399/260
5,508,792 A * 4/1996 Ishida et al. ..... 399/256
5,943,538 A * 8/1999 Choi ..... 399/258
6,035,168 A * 3/2000 Masuda et al. ..... 399/254
6,556,801 B1 * 4/2003 Shimaoka et al. ..... 399/258
6,999,704 B2 * 2/2006 Hayashi et al. ..... 399/258
7,088,943 B2 * 8/2006 Iikura et al. ..... 399/260
7,251,440 B2 * 7/2007 Shigeta et al. ..... 399/254
2004/0001723 A1 * 1/2004 Ashida et al. ..... 399/263 X
2005/0196184 A1 * 9/2005 Koyama et al. ..... 399/260 X
2006/0222412 A1 * 10/2006 Ito et al. ..... 399/258
2006/0257173 A1 * 11/2006 Endoh ..... 399/258

FOREIGN PATENT DOCUMENTS

JP 07-168507 A * 7/1995
JP 2004-029677 A * 1/2004
JP 2004-101760 A 4/2004

* cited by examiner

*Primary Examiner*—Sophia S Chen
(74) *Attorney, Agent, or Firm*—Sughrue Mion, PLLC

(57) ABSTRACT

Provided is a process cartridge including: a first developer accommodating section and a second developer accommodating section provided by splitting a developer accommodating space; a developer passage that connects a developer feed inlet opening to the first developer accommodating section and a developer feed outlet opening to the second developer accommodating section; a first stirring/conveying member that is rotatably disposed in the first developer accommodating section and stirs/conveys the developer within the first developer accommodating section; and at least two second stirring/conveying members that are rotatably disposed in the second developer accommodating section and stir/convey the developer within the second developer accommodating section. The developer feed outlet is arranged in a position overlapping a projection face of one second stirring/conveying member out of the plurality of second stirring/conveying members to the second developer accommodating section.

21 Claims, 7 Drawing Sheets

PROCESS CARTRIDGE, IMAGE FORMING APPARATUS AND METHOD OF ASSEMBLING PROCESS CARTRIDGES

BACKGROUND

1. Technical Field

The present invention relates to an image forming apparatus such as a printer, copying machine or facsimile, a process cartridge for use therein and a method of assembling such process cartridges.

2. Related Art

Known image forming apparatuses include one in which a process cartridge is detachably fitted to the image forming apparatus body. In one of conventional process cartridges, its developer accommodating space is split in the vertical direction with a window constituting a scanning beam path in-between and the split parts of the developer accommodating space are connected by a developer passage.

However, according to the related art referenced above, the developer passage connecting the upper segment and the lower segment of the developer accommodating space is sometimes clogged with the developer or has other trouble, and the developer is thereby prevented from being conveyed smoothly.

SUMMARY

The present invention aims to provide a process cartridge and an image forming apparatus permitting smooth conveyance of a developer, and a method of assembling such process cartridges.

According to an aspect of the invention, a process cartridge having an image holder that is detachably fitted to an image forming apparatus body and a developing device that makes a latent image formed on the image holder visible and having a developer accommodating space, includes: a first developer accommodating section and a second developer accommodating section provided by splitting the developer accommodating space; a developer passage that connects a developer feed inlet opening to the first developer accommodating section and a developer feed outlet opening to the second developer accommodating section; a first stirring/conveying member that is rotatably disposed in the first developer accommodating section and stirs/conveys the developer within the first developer accommodating section; and at least two second stirring/conveying members that are rotatably disposed in the second developer accommodating section and stir/convey the developer within the second developer accommodating section, wherein the developer feed outlet is arranged in a position overlapping a projection face of one second stirring/conveying member out of the plural second stirring/conveying members to the second developer accommodating section.

BRIEF DESCRIPTION OF THE DRAWINGS

Exemplary embodiments of the present invention will be described in detail based on the following figures, wherein.

DETAILED DESCRIPTION

Exemplary embodiments of the present invention will be described below with reference to the accompanying drawings.

Figure 1:
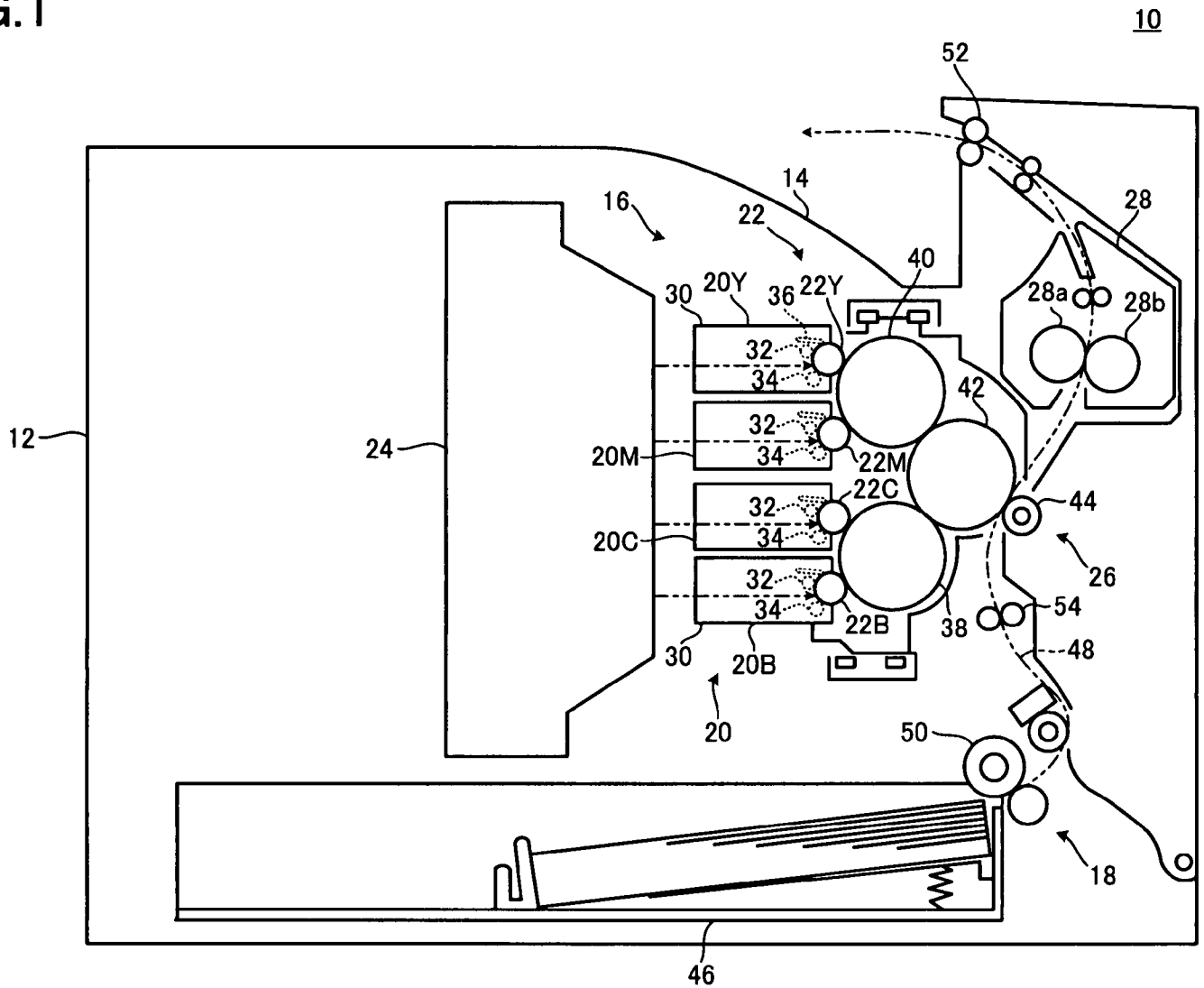
FIG. 1 shows a profile of an image forming apparatus, which is a first exemplary embodiment of the invention.

FIG. 1 shows an image forming apparatus 10, which is an exemplary embodiment of the invention. This image forming apparatus 10 has an image forming apparatus body 12. A discharge unit 14, to which sheets on each of which an image is formed is discharged, is disposed at the top of this image forming apparatus body 12, and an image forming unit 16 and a sheet feeding device 18 are arranged within the image forming apparatus body 12.

The image forming unit 16 is an electrophotographic device which forms color images. It has four process cartridges 20Y, 20M, 20C and 20B detachably fitted to the image forming apparatus body 12, an optical write-in device 24 which optically writes electrostatic images into photoreceptors 22Y, 22M, 22C and 22B which the process cartridges 20Y, 20M, 20C and 20B respectively have, an image transfer device 26 which transfers a developer image formed on the photoreceptors 22Y, 22M, 22C and 22B as image holders to a sheet, and a fixing device 28 which fixes the developer image transferred by the image transfer device 26 to the sheet.

The process cartridge 20Y is for yellow; the process cartridge 20M is for magenta; the process cartridge 20C is for cyan; and the process cartridge 20B is for black. The process cartridges are vertically arranged in the image forming apparatus body 12 in the order of, for instance, the process cartridge 20Y, the process cartridge 20M, the process cartridge 20C and the process cartridge 20B from top to bottom. Since the process cartridges are the same in configuration though differing in the color of the developer, they will be collectively referred to as process cartridges 20 in the following description.

Each of the process cartridges 20 has a process cartridge body 30, and a photoreceptor 22, a charger 32 provided with a charging roller for electrically charging this photoreceptor 22, a developing device 34 which develops with a developer a latent image charged by this charger 32 and written onto the photoreceptor 22 by the optical write-in device 24, and a cleaning device 36 which, after the developer image has been transferred by the image transfer device 26, clears the photoreceptor 22 of the residual developer are arranged in this process cartridge body 30.

The optical write-in device 24 is composed of a laser exposing device for instance. It emits a laser beam matching a yellow image to the photoreceptor 22Y disposed in the process cartridge 20Y, one matching a magenta image to the photoreceptor 22M in the process cartridge 20M, one matching a cyan image to the photoreceptor 22C in the process cartridge 20C, and one matching a black image to laser beam the photoreceptor 22B in the process cartridge 20B, and writes latent images onto the respective photoreceptors 22.

The image transfer device 26 has two first intermediate transfer media 38 and 40 to which the developer image formed on the photoreceptor 22 of each process cartridge 20 is transferred, a second intermediate transfer medium 42 to which the developer image transferred to the first intermediate transfer media 38 and 40 is further transferred, and a third intermediate transfer roller 44 which further transfers the developer image transferred to the second intermediate transfer medium 42 to a sheet.

The first intermediate transfer medium 38 is drum-shaped, and is in contact with the photoreceptor 22C provided on the cyan process cartridge 20C and the photoreceptor 22B provided on the black process cartridge 20B. The black developer image formed on the photoreceptor 22B and the cyan developer image formed on the photoreceptor 22C are transferred to this first intermediate transfer medium 38, and the cyan developer image and the black developer image are superposed one over the other on the surface of the first intermediate transfer medium 38.

The first intermediate transfer medium 40 is drum-shaped, and is disposed above the first intermediate transfer medium 38. This first intermediate transfer medium 40 is in contact with the photoreceptor 22Y provided on the yellow process cartridge 20Y and the photoreceptor 22M provided on the magenta process cartridge 20M. The yellow developer image formed on the photoreceptor 22Y and the magenta developer image formed on the photoreceptor 22M are transferred to this first intermediate transfer medium 40, and the yellow developer image and the magenta developer image are superposed one over the other on the surface of the first intermediate transfer medium 40.

The second intermediate transfer medium 42 is drum-shaped, and is in contact with the first intermediate transfer medium 38 and the first intermediate transfer medium 40. The cyan developer image and the black developer image on the surface of the first intermediate transfer medium 38 are transferred to the second intermediate transfer medium 42, and so are the yellow developer image and the magenta developer image on the surface of the first intermediate transfer medium 40. In this way, the developer images of four colors including yellow, magenta, cyan and black are superposed on the surface of the second intermediate transfer medium 42.

The third intermediate transfer roller 44, in contact with the second intermediate transfer medium 42, forms a nipping portion between it and the second intermediate transfer medium 42, and transfers a color developer image including superposed developer images of four colors including yellow, magenta, cyan and black to the sheet passing this nipping portion.

The fixing device 28, including a heating roller 28*a* and a pressing roller 28*b*, fixes the developer image onto the sheet passing between the heating roller 28*a* and the pressing roller 28*b* by heating and pressing the sheet.

The sheet feeding device 18 has a sheet feeding cassette 46 in which sheets are held stacked one over another, and a conveyance roller 50 which picks up a sheet from the sheet feeding cassette 46 and forwards it to a sheet conveyance path 48. The sheet conveyance path 48 is a path over which sheets are conveyed from the sheet feeding cassette 46 to a discharge roller 52, and on this sheet conveyance path 48 there arranged, from the upstream side in the sheet conveying direction, the conveyance roller 50, a resist roller 54, the nipping portion formed by the third intermediate transfer roller 44 and the second intermediate transfer medium 42, the fixing device 28 and the discharge roller 52.

Therefore, the photoreceptors 22 are uniformly charged by the charger 32, latent images are formed thereon by the optical write-in device 24, and the latent images are made visible by the developer in the developing device 34. The developer image formed on each photoreceptor 22, after being transferred to the first intermediate transfer media 38 and 40, is transferred to the second intermediate transfer medium 42. On the other hand, a sheet from the sheet feeding cassette 46 is conveyed by the conveyance roller 50 to the sheet conveyance path 48. Developer images are transferred to the sheet in the nipping portion between the second intermediate transfer medium 42 and the third intermediate transfer roller 44, and are fixed by the fixing device 28, and the sheet is discharged by the discharge roller 52 into the discharge unit 14.

Figure 2:
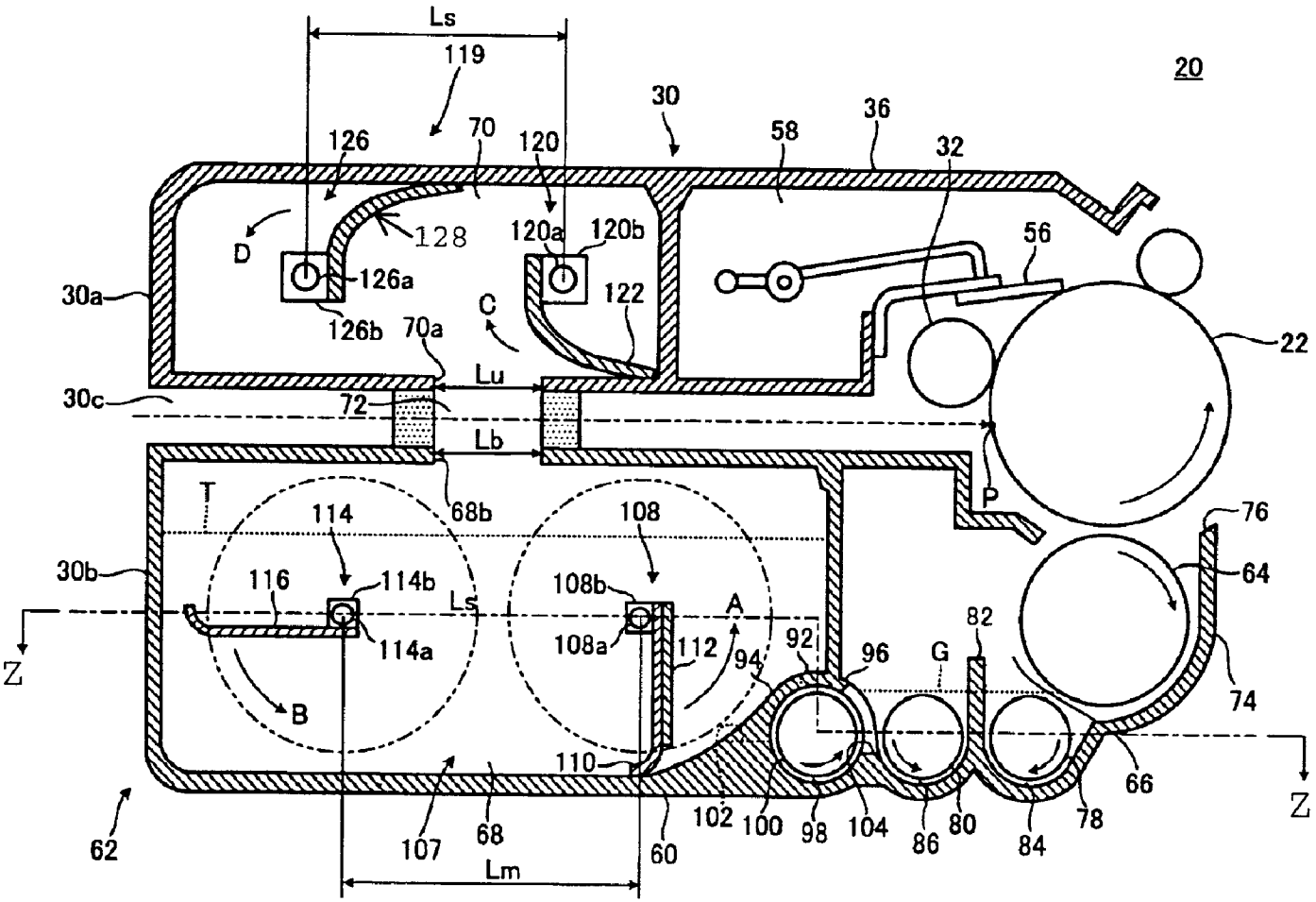
FIG. 2 shows a longitudinal section of the process cartridge for use in the image forming apparatus, which is the first exemplary embodiment of the invention.
Figure 3:
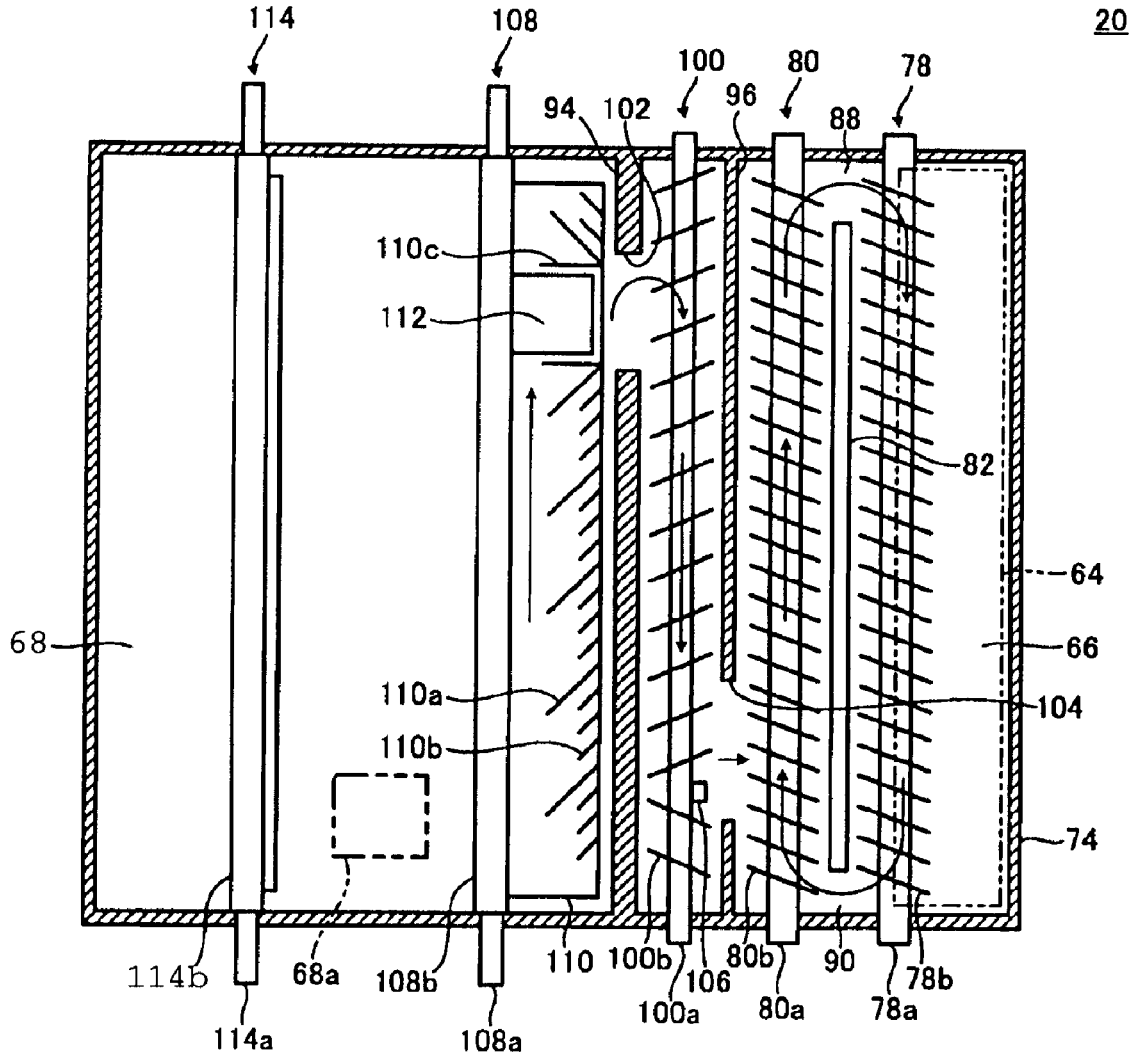
FIG. 3 is a section along line Z-Z of this drawing, which shows the process cartridge in the first exemplary embodiment of the invention.
Figure 4:
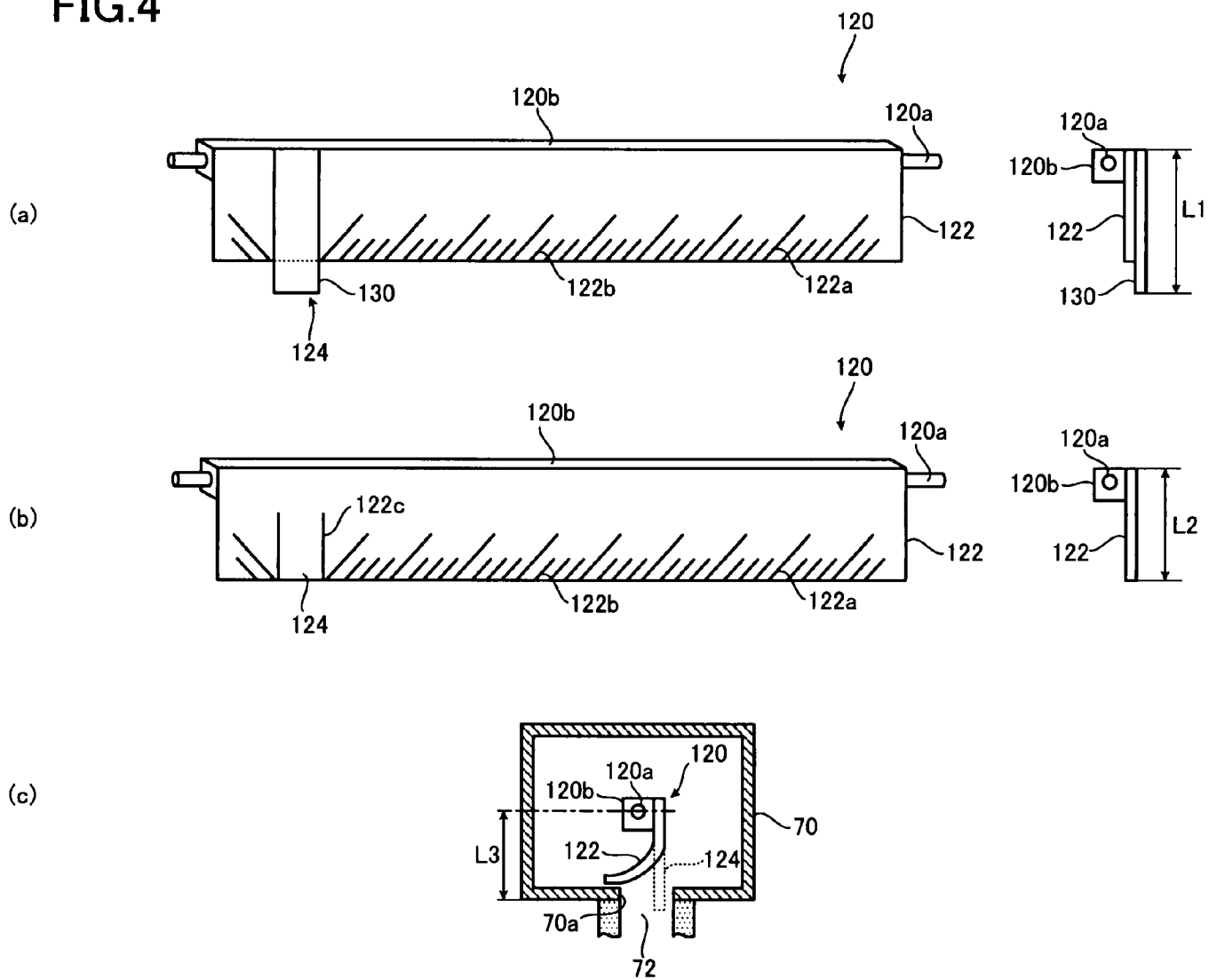
FIGS. 4(*a*) to 4(*c*) show an agitator in the first exemplary embodiment of the invention, FIG. 4(*a*) showing a loosening section using a flexible member, FIG. 4(*b*), another loosening section using cuts and FIG. 4(*c*), illustrating the length of a conveying film.

FIGS. 2 through 4(*c*) show details of the process cartridges 20 in the first exemplary embodiment of the invention.

As shown in FIG. 2, each of the process cartridges 20 has the process cartridge body 30, and a scanning beam path 30*c* is provided in this process cartridge body 30 in the horizontal direction from one end to near the other end so that the scanning beam from the optical write-in device 24 passes this scanning beam path 30*c* to reach the photoreceptor 22. The process cartridge body 30 further has a cartridge upper body 30*a* positioned in the upper part via the scanning beam path 30*c* and a cartridge lower body 30*b* positioned in the lower part via the scanning beam path 30*c*. The photoreceptor 22, the cleaning device 36 and so forth are arranged in the cartridge upper body 30*a*, and the developing device 34 is arranged in the cartridge lower body 30*b*.

The cleaning device 36 has a cleaning blade 56 and a developer accommodating unit 58. The cleaning blade 56 scrapes off the developer remaining on the surfaces of the photoreceptors 22, and the developer accommodating unit 58 accommodates the waste developer removed by the cleaning blade 56.

The developing device 34 according to the invention uses, for instance, a two-component developing system.

The developing device 34 has a developing device body 60, and the inside of this developing device body 60 is divided into a developer accommodating space 62 and a developing section 66 provided with a developing roller 64. The developer accommodating space 62 is divided by a horizontal line P (the scanning beam path from the optical write-in device in this exemplary embodiment) as the border into a main tank 68 as a first developer accommodating section positioned below and a sub-tank 70 as a second developer accommodating section positioned above. The main tank 68 and the sub-tank 70 are formed to have a rectangular section, and the developer capacity of the main tank 68 is greater than that of the sub-tank 70. A developer passage 72 is arranged between the main tank 68 and the sub-tank 70 to connect the main tank 68 and the sub-tank 70.

The developer passage 72, composed of an elastic member such as urethane foam, is stuck to the upper part of the main tank 68 with an adhesive or the like and is pressure-welded to the lower par of the sub-tank 70. The developer passage 72 is so disposed as to connect a developer feed inlet 68*b*, to be described afterwards, opening to the main tank 68 and a developer feed outlet 70*a* opening to the sub-tank 70. In this way, the main tank 68 and the sub-tank 70 are connected by the developer feed outlet 70*a*, the developer passage 72 and the developer feed inlet 68*b*. Further, the use of the elastic member for the developer passage 72 can prevent the toner from leaking even if the cartridge upper body 30*a* and the cartridge lower body 30*b* vibrate or are displaced independent of each other.

The cartridge lower body 30*b* has a housing 74. The housing 74, disposed underneath the photoreceptor 22, has an opening 76 open toward the photoreceptor 22. A developing chamber 66 is formed within the housing 74, and a developer G made up of a toner and a carrier is accommodated in this developing chamber 66. Further, the developing roller 64 is so disposed within the housing 74 that part of it is exposed from the opening 76 of the housing 74, and the developing roller 64 is rotatably supported by the surrounding wall of the housing 74. The developing roller 64 magnetically attracts the carrier contained in the developer G, thereby forms a magnetic brush of the developer G on the surface of the developing roller 64, and conveys the toner attracted to the carrier to the developing area opposite the photoreceptor 22. Then, the latent image formed on the photoreceptor 22 is made visible by the magnetic brush of the developer G including the carrier and the toner, formed on the surface of the developing roller 64.

A first stirring/conveying auger 78 and a second stirring/conveying auger 80 is arranged underneath the developing roller 64 in the axial direction of the developing roller 64. As shown in FIG. 3, the first stirring/conveying auger 78 and the second stirring/conveying auger 80 respectively have rotation shafts 78*a* and 80*a*, and the rotation shafts 78*a* and 80*a* rotatably supported by the surrounding wall of the housing 74. Spiral vanes 78*b* and 80*b* are spirally wound around the first stirring/conveying auger 78 and the second stirring/conveying auger 80, respectively, at prescribed pitches. When the first stirring/conveying auger 78 and the second stirring/conveying auger 80 turn, the developer G accommodated in the developing chamber 66 is conveyed in the axial directions of the first stirring/conveying auger 78 and the second stirring/conveying auger 80 by the spiral vanes 78*b* and 80*b* while being stirred.

A first partitioning wall 82 is disposed between the first stirring/conveying auger 78 and the second stirring/conveying auger 80, and the inside of the developing chamber 66 is bisected by this first partitioning wall 82 into a first stirring path 84 in which the first stirring/conveying auger 78 is arranged and a second stirring path 86 in which the second stirring/conveying auger 80 is arranged. Connection ports 88 and 90 are formed at the two ends of this first partitioning wall 82 in the longer-length direction, and the first stirring path 84 and the second stirring path 86 are connected by these connection ports 88 and 90. Therefore, the developer G in the developing chamber 66 is conveyed within the first stirring path 84 and the second stirring path 86 while being stirred by the turning of the first stirring/conveying auger 78 and the second stirring/conveying auger 80, and circulates between the first stirring path 84 and the second stirring path 86.

A second partitioning wall 92, a curved wall 94 and a third partitioning wall 96 are disposed between the main tank 68 and the developing chamber 66. The curved wall 94 is so formed as to extend from the lower part of the second partitioning wall 92 towards the main tank 68 to form a tunnel-shaped dispense chamber 98 in the bottom part of the housing 74. Within the dispense chamber 98, a dispense auger 100 which stirs and conveys the toner is disposed in the longer-length direction. Near one end of the curved wall 94, a first toner discharge port 102 which connects the main tank 68 and the dispense chamber 98 is formed. The toner T accommodated in the main tank 68 is stirred by a first agitator 108 to be described afterwards, at the same time conveyed within the main tank 68 in the axial direction of the first agitator 108, and discharged through the first toner discharge port 102 into the dispense chamber 98.

On the other hand, at the other end of the third partitioning wall 96 in the longer-length direction, a second toner discharge port 104 which connects the dispense chamber 98 and the developing chamber 66 is formed. The toner T in the dispense chamber 98 is conveyed by the dispense auger 100 in the axial direction of the dispense auger 100, and fed from the second toner discharge port 104 to the developing chamber 66. This toner discharge port 104 is so formed that its lower end is positioned lower than the surface position of the developer G accommodated in the developing chamber 66. This results in embedding of at least a part of the second toner discharge port 104 in the developer G accommodated in the developing chamber 66, so that the toner T fed from the dispense chamber 98 to the developing chamber 66 creeps into the developer G to facilitate mixing of the developer G and the toner T accommodated in the developing chamber 66.

The dispense auger 100, the first stirring/conveying auger 78 and the second stirring/conveying auger 80 are of substantially the same configuration and, as shown in FIG. 3, are provided with a rotation shaft 100*a*, with the rotation shaft 100*a* being rotatably supported by the surrounding wall of the main tank 68. A spiral vane 100*b* is wound around this rotation shaft 100*a* at a prescribed pitch. Further, a planar piece 106 is formed on the rotation shaft 100*a* of the dispense auger 100 in a position opposite the second toner discharge port 104. The planar piece 106 protrudes in the radial direction of the rotation shaft 100*a*, and its longer-length direction is arranged along the axis of the rotation shaft 100*a*. Therefore, the toner T is conveyed within the dispense chamber 98 in the direction of the rotation shaft of the dispense auger 100 by the turning of the dispense auger 100 and, when it reaches a position opposite the second toner discharge port 104, is stirred by the spiral vane 100*b* and further by the planar piece 106 to be fed through the second toner discharge port 104 to the developing chamber 66.

A main tank agitator 107 as a first stirring/conveying member has the first agitator 108 and a second agitator 114. The first agitator 108 has a first rotation shaft 108*a*, a first support 108*b*, a first stirring/conveying film 110 as a film member and an auxiliary film 112, and is rotatably supported by the surrounding wall of the main tank 68. The second agitator 114 is provided with a second rotation shaft 114*a*, a second support 114*b* and a second stirring/conveying film 116 as a film member, and is rotatably supported by the surrounding wall of the main tank 68.

The arrangement is such that the extending direction of the first stirring/conveying film 110 from the first rotation shaft 108*a* and that of the second stirring/conveying film 116 from the second rotation shaft 114*a* form an angle of approximately 90 degrees, so that the first agitator 108 and the second agitator 114 turn maintaining an angle of approximately 90 degrees between them. This enables the stirring/conveying of the toner T in the main tank 68 to be stabilized because any area in which the quantity of the toner T has been reduced by the stirring/conveying of the toner T along with the turning of the first agitator 108 is replenished with the toner T by the stirring/conveying by the second agitator 114 which is delayed in turning.

The first stirring/conveying film 110 is formed of a flexible resin film, such as PET, having a thickness of 50 to 300 .mu·m for instance, and is fixed with an adhesive or the like throughout in the direction of the first support 108*b* of the first agitator 108. As shown in FIG. 3, first cuts 110*a*, second cuts 110*b* and third cuts 10*c* are formed at one end (tip) of this first stirring/conveying film 110 in the shorter-length direction. These first cuts 110*a* and second cuts 10*b* form an angle of approximately 45 degrees to the axial direction of the first support 108*b*, and are respectively arranged from the two ends of the first stirring/conveying film 110 in the longer-length direction toward the toner discharge port 102. The first cuts 110*a* are longer than the second cuts 110*b*. Each of the third cuts 110*c* is disposed between a pair of first cuts 110*a*. A pair of these third cuts 110*c* are provided in a position opposite the first toner discharge port 102 and at two ends of an auxiliary film 112 to be described afterwards in its widthwise direction, and the direction of the third cuts 110*c* is the direction of the turning radius of the first support 108*b*.

The auxiliary film 112 is disposed in the area of the first stirring/conveying film 110 positioned between the pair of third cuts 110*c*. This auxiliary film 112, formed of a flexible resin film such as PET, is superposed over the first stirring/conveying film 110, and with one of its ends stuck to the first stirring/conveying film 110 with an adhesive or the like, is held by the first support 108*b* while the other end is free.

As shown in FIG. 2, a developer feed inlet 68*a* is arranged between, the first rotation shaft 108*a* of the first agitator 108 and the second rotation shaft 114*a* of the second agitator 114. Therefore, when the toner in the sub-tank 70 is conveyed into the main tank 68 via the developer passage 72 and the developer feed inlet 68*a*, it is smoothly conveyed because of the absence of any obstacle, such as a rotation shaft. Since the area in the main tank 68 between the first rotation shaft 108*a* and the second rotation shaft 114*a* is higher in conveyance capacity (the area of conveyance per cycle the first stirring/conveying film 110 and the second stirring/conveying film 116) than other areas, accumulation of toner in the vicinities of the developer feed inlet 68*a* is restrained thereby to prevent clogging with toner.

Further as shown in FIG. 3, the developer feed inlet 68*a* is arranged near one end of the first rotation shaft 108*a*, and the first toner discharge port 102 is arranged near the other end of the first rotation shaft 108*a*. Thus, the developer feed inlet 68*a* is arranged on the upstream side of toner conveyance, and the first toner discharge port 102, on the downstream side. Therefore, even if toner is excessively fed from the developer feed inlet 68*a*, the toner is uniformized while is being stirred and conveyed by the first stirring/conveying film 110 and the second stirring/conveying film 116, so that a substantially constant quantity of toner can be discharged from the first toner discharge port 102. Also, until immediately before the toner in the main tank 68 substantially runs out, a substantially constant quantity of toner can be discharged from the first toner discharge port 102.

The width of the developer feed inlet 68*a* (Lb in FIG. 2) is either equal to or greater than that of a developer feed outlet 70*a* (Lu in FIG. 2) to be described afterwards. By setting the width of the developer feed inlet 68*a* greater than that of the developer feed outlet 70*a*, clogging of the developer passage 72 with the developer can be restrained.

A sub-tank agitator 119 as a second stirring/conveying member includes a third agitator 120 and a fourth agitator 126. The third agitator 120, provided with a third rotation shaft 120*a*, a third support 120*b* and a third stirring/conveying film 122 as a film member, is rotatably supported by the surrounding wall of the sub-tank 70. The fourth agitator 126, provided with a fourth rotation shaft 126*a*, a fourth support 126*b* and a fourth stirring/conveying film 128 as a film member, is rotatably supported by the surrounding wall of the sub-tank 70.

The third agitator 120 and the fourth agitator 126 are so arranged that the center distance of the third rotation shaft 120*a* of the third agitator 120 and the fourth rotation shaft 126*a* of the fourth agitator 126 (Ls in FIG. 2) is shorter than the center distance of the first rotation shaft 108*a* of the first agitator 108 and the second rotation shaft 114*a* of the second agitator 114 (Lm in FIG. 2). Therefore, the developer accommodating capacity of the main tank 68 can be set greater than the developer accommodating capacity of the sub-tank 70. Furthermore, since the sub-tank agitator 119 is smaller than the main tank agitator 107, the quantity of toner conveyed from the sub-tank 70 to the main tank 68 is made smaller than that within the main tank 68, which contributes to smoothing the conveyance of toner from the sub-tank 70 to the main tank 68.

Further, the arrangement is such that the extending direction of the third stirring/conveying film 122 from the third rotation shaft 120*a* and that of the fourth stirring/conveying film 128 from fourth rotation shaft 126*a* form an angle of approximately 180 degrees, so that the third agitator 120 and the fourth agitator 126 turn maintaining an angle of approximately 180 degrees between them. This enables the stirring/conveying of the toner in the sub-tank 70 to be stabilized because any area in which the quantity of the toner has been reduced by the stirring/conveying of the toner along with the turning of the third agitator 120 is replenished with the toner by the stirring/conveying by the fourth agitator 126 which is delayed in turning.

Further as shown in FIG. 4, the third stirring/conveying film 122 is formed of a flexible resin film, such as PET, having a thickness of 50 to 300 μm for instance, and is fixed with an adhesive or the like throughout in the direction of the third support 120*b* of the third agitator 120. As shown in FIG. 3, first cuts 122*a*, second cuts 122*b* and third cuts 122*c* are formed at one end (tip) of this third stirring/conveying film 122 in the shorter-length direction. These first cuts 122*a* and second cuts 122*b* form an angle of approximately 45 degrees to the axial direction of the third support 120*b*, and each is plurally disposed from the two ends of the third stirring/conveying film 122 in the longer-length direction toward the developer feed outlet 70*a* to be described afterwards. The first cuts 122*a* are longer than the second cuts 122*b*. Each of the third cuts 122*c* is disposed between a pair of first cuts 122*a*. A pair of these third cuts 122*c* are provided in a position opposite the developer feed outlet 70*a*, and the direction of the third cuts 122*c* is the direction of the turning radius of the third support 120*b*. Therefore, the toner accommodated in the sub-tank 70, when the third agitator 120 turns, is conveyed in the axial direction of the third agitator 120 by the action of the third stirring/conveying film 122 and accepted into the developer feed outlet 68*a*.

As shown in FIG. 2, the developer feed outlet 70*a* is arranged in a position overlapping the projection face of the third agitator 120 to the sub-tank 70. More specifically, the developer feed outlet 70*a* is arranged in a position immediately underneath the third stirring/conveying film 122 when the third stirring/conveying film 122 is in the vertical direction (directed right downward). This arrangement of overlapping the projection face of the third agitator 120 to the sub-tank 70, compared with a position away from the projection face of the third agitator to the sub-tank 70, enables the toner in the sub-tank 70 to be securely accepted into the developer feed outlet 70*a* and thereby to reduce the residue in the sub-tank 70 because it is a position in which the force of the third stirring/conveying film 122 to convey the toner in the sub-tank 70 is strong. Incidentally, the developer feed outlet 70*a* may as well be arranged immediately underneath the third rotation shaft 120*a* of the third agitator 120. In this case, the distance between the center of the third rotation shaft 120*a* and the developer feed outlet 70*a* is shortened, and the force of the third stirring/conveying film 122 to convey the toner in the sub-tank 70 is strengthened, thereby enabling the toner in the sub-tank 70 to be securely accepted into the developer feed outlet 70*a*.

The width of the developer feed outlet 70*a* (Lu in FIG. 2) is smaller than the center distance between the first rotation shaft 108*a* of the first agitator 108 and the second rotation shaft 114*a* of the second agitator 114 (Lm in FIG. 2). By keeping the width of the developer feed outlet 70*a* not greater than the center distance between the rotation shaft 108*a* and the rotation shaft 114*a* in this way, the quantity of toner conveyed by the third agitator 120 can be made more stable than in a case in which the width of the developer feed outlet 70*a* is greater than the center distance between the rotation shaft 108*a* and the rotation shaft 114*a*.

As shown in FIG. 4, the aforementioned area between the pair of third cuts 122*c* of the third stirring/conveying film 122 is positioned opposite the developer feed outlet 70*a*, has a size permitting entrance into the developer feed outlet 70*a*, and is used as a loosening section 124 in which any soft blocking arising in the developer passage 72 is to be crushed. Thus, the loosening section 124 is simply structured, resulting in reduced weight and cost. Incidentally, this loosening section 124 may have a flexible member 130 in a position opposite the developer feed outlet 70*a* of the third stirring/conveying film 122. This flexible member may be integrated with the third stirring/conveying film 122 or formed as a separate member from the third stirring/conveying film 122. The length of the loosening section 124 in the shorter-length direction (L1 in FIG. 4(*a*) and L2 in FIG. 4(*b*)) is kept not longer than the distance from the center of the third rotation shaft 120*a* to the developer feed outlet 70*a* (L3 in FIG. 4(*c*)). Since the loosening section 124 is so formed as to enter into at least part of the developer passage 72 via the developer feed outlet 70*a* in this way, any soft blocking arising in the developer passage 72 can be crushed thereby to eliminate clogging of the developer passage 72.

Next, the method of assembling the process cartridge 20 in this exemplary embodiment will be described with reference to FIG. 2.

First, the main tank agitator 107 is fitted to the main tank 68 of the cartridge lower body 30*b* shown in FIG. 2. In this procedure, the first agitator 108 and the second agitator 114 are fitted at mutually different prescribed angles so that they become different in phase. In this example, the first agitator 108 is fitted at an angle approximately 90 degrees ahead of the second agitator 114 in the turning direction. Then, the sub-tank agitator 119 is fitted to the sub-tank 70 of the cartridge upper body 30*a*. In this procedure, the third agitator 120 and the fourth agitator 126 are fitted at mutually different angles so that they become different in phase. In this example, they are so fitted as to make the phases of the third agitator 120 and of the fourth agitator 126 approximately 180 degrees different from each other.

Incidentally, the sequence of fitting the agitators to the process cartridge 20 is not limited to the foregoing but it may be another appropriate sequence.

By fitting in this way the first agitator 108, the second agitator 114, the third agitator 120 and the fourth agitator 126 to the process cartridge body 30 at respectively prescribed angles, when the agitators are driven at equal speed, the timing at which the third stirring/conveying film 122 of the third agitator 120 and the fourth stirring/conveying film 128 of the fourth agitator 126 come to oppose the developer feed outlet 70*a* and the timing at which the first stirring/conveying film 110 of the first agitator 108 and the second stirring/conveying film 116 of the second agitator 114 come to overlap the projection face of the developer feed inlet 68*a* are differentiated.

Figure 5:
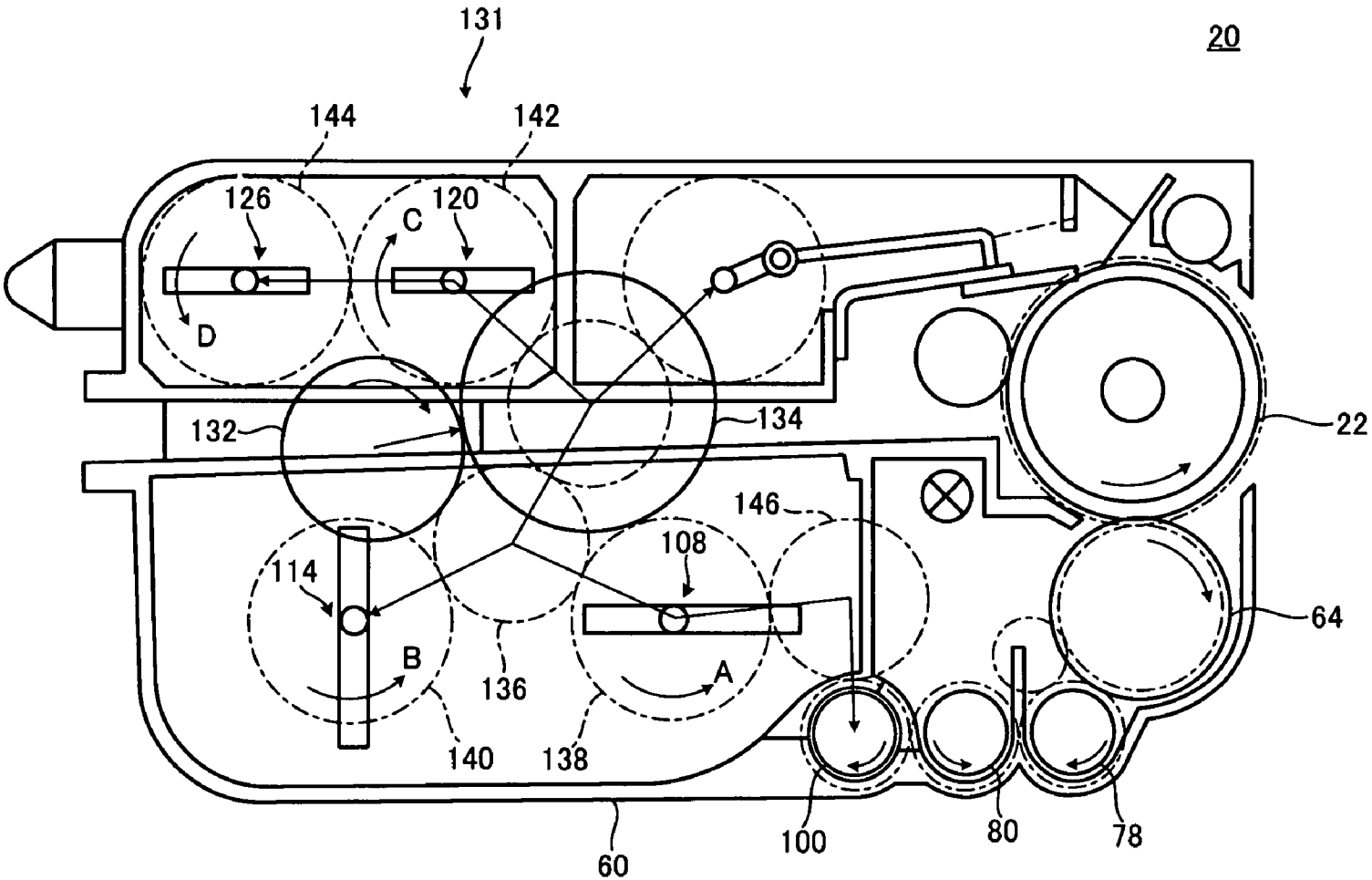
FIG. 5 shows a front view of the driving system for the process cartridge in the first exemplary embodiment of the invention.

FIG. 5 shows a drive transmission device 131 in this exemplary embodiment of the invention.

The drive transmission device 131, disposed on a side of the process cartridge 20, has a drive gear 132 connected to a drive power source (not shown), a first idle gear 134, a second idle gear 136, a first agitator drive gear 138, a second agitator drive gear 140, a third agitator drive gear 142, a fourth agitator drive gear 144 and a linking gear 146.

The first agitator drive gear 138 is linked to the first agitator 108 and the second agitator drive gear 140, to the second agitator 114. The third agitator drive gear 142 is linked to the third agitator 120 and the fourth agitator drive gear 144, to the fourth agitator 126. The drive gear 132 is linked to the first idle gear 134, which is linked to the second idle gear 136 and the third agitator drive gear 142. The second idle gear 136 is linked to the first agitator drive gear 138 and the second agitator drive gear 140, and the third agitator drive gear 142 is linked to the fourth agitator drive gear 144. Their gear ratios are so set as to cause the first agitator 108, the second agitator 114, the third agitator 120 and the fourth agitator 126 to turn at equal speed. Therefore, when driving force is transmitted from the drive power source (not shown) to the drive gear 132, the first agitator 108 turns in the direction of arrow A, the second agitator 114 turns in that of arrow B, the third agitator 120 in that of arrow C and the fourth agitator 126 turns in that of arrow D, all at equal speed.

By turning the first agitator 108, the second agitator 114, the third agitator 120 and the fourth agitator 126 at equal speed in this way, as described above, the timing at which the third stirring/conveying film 122 comes to oppose the developer feed outlet 70*a* and the timing at which the first stirring/conveying film 110 and the second stirring/conveying film 116 come to overlap the projection face of the developer feed inlet 68*a* are differentiated. Therefore, the toner in the sub-tank 70 is smoothly supplied to the main tank 68 via the developer passage 72.

The first agitator drive gear 138 is linked to the linking gear 146, and this linking gear 146 transmits the driving force to the dispense auger 100, the second stirring/conveying auger 80, the first stirring/conveying auger 78, the developing roller 64 and the photoreceptors 22.

Figure 6:
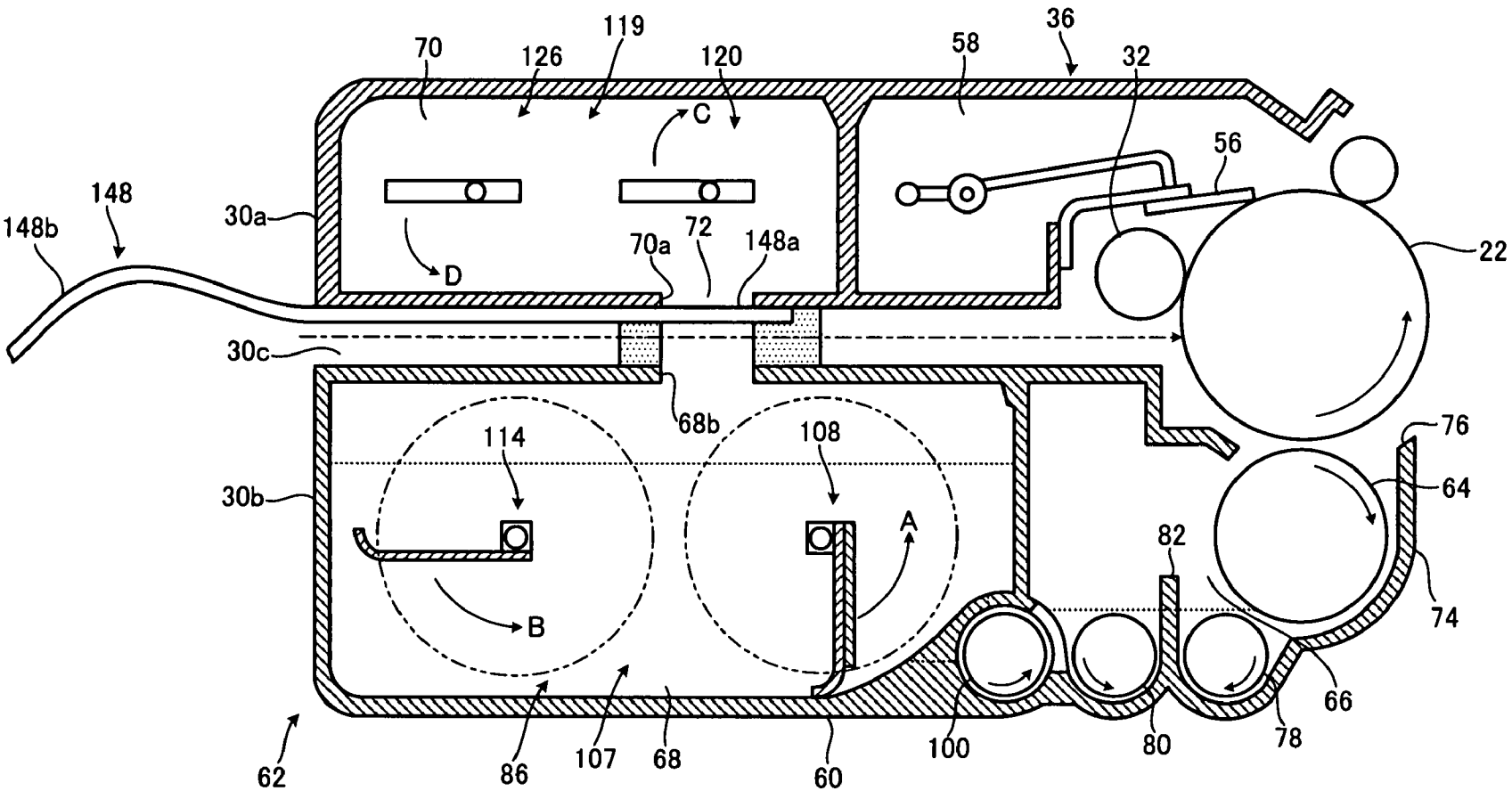
FIG. 6 shows a longitudinal section of a sealing member for use in the process cartridge in the first exemplary embodiment of the invention.

FIG. 6 shows a sealing member 148 for use in the process cartridge 20.

As shown in FIG. 6, the sealing member 148 as an intercepting member is formed in a strip shape having a prescribed width, disposed between the cartridge upper body 30*a* and the cartridge lower body 30*b*, namely on the scanning beam path 30*c*, and the tip 148*a* of the sealing member 148 is held between the lower part of the sub-tank 70 and the upper end of the developer passage 72. The connection between the sub-tank 70 and the main tank 68 is intercepted by this sealing member 148. The rear end 148*b* of the sealing member 148 is positioned outside the process cartridge body 30. Therefore, the presence of this sealing member 148 serves to prevent the toner in the sub-tank 70 from shifting into the main tank 68 during the conveyance (carriage) of the process cartridge 20, and the occurrence of toner blocking in the main tank 68 is thereby prevented. Incidentally, this sealing member 148 can be easily removed by the user by pulling its rear end 148*b*.

Figure 7:
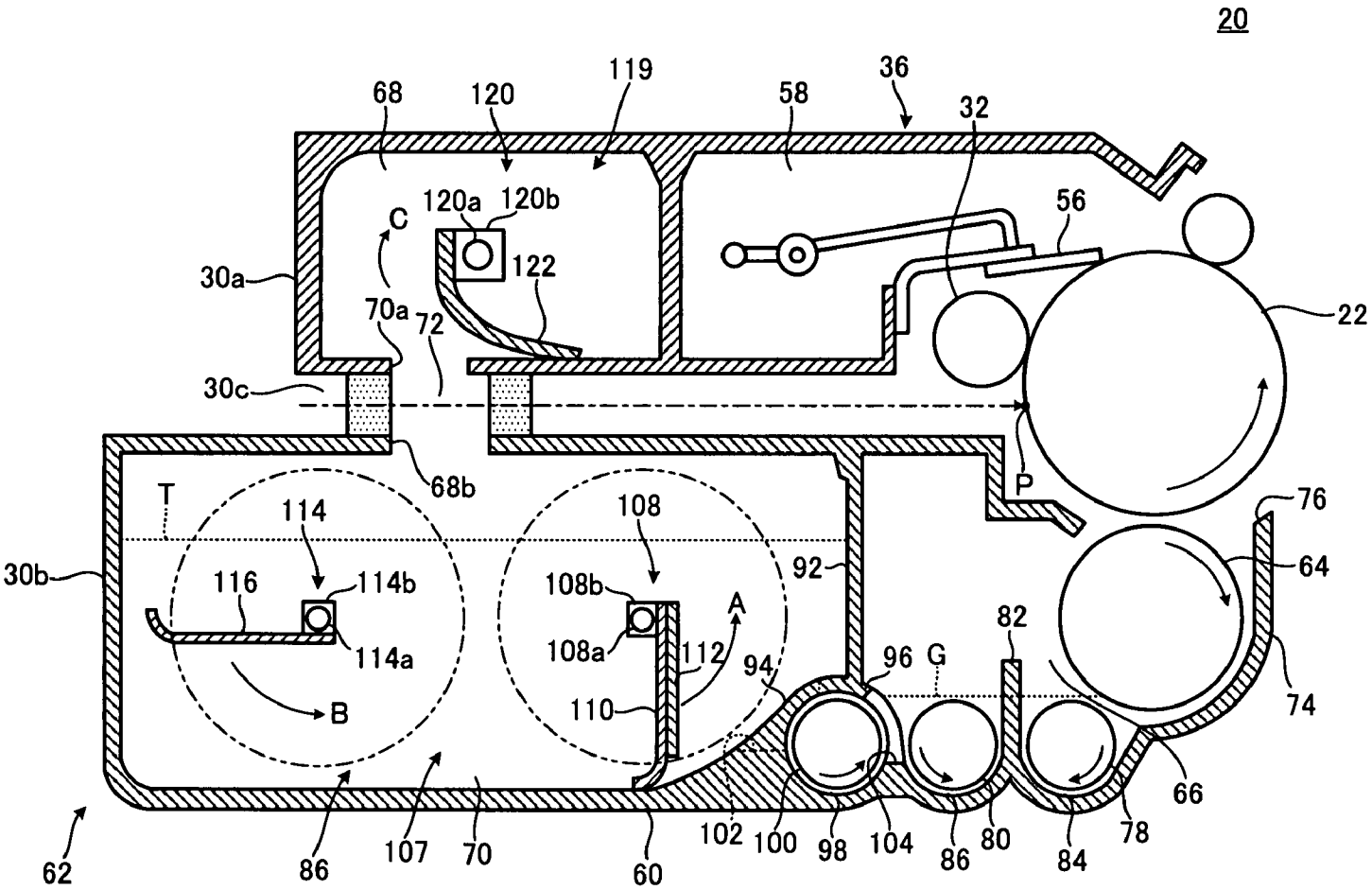
FIG. 7 shows a longitudinal section of a process cartridge, which is a second exemplary embodiment of the invention.

FIG. 7 shows a process cartridge 20, which is a second exemplary embodiment of the invention.

The process cartridge 20, which is the second exemplary embodiment differs from the process cartridge 20, which is the first exemplary embodiment described above, in the configuration of the sub-tank 70. The sub-tank agitator 119 arranged in the sub-tank 70 has only the third agitator 120. The developer feed outlet 70*a* is arranged in a position overlapping the projection face of the third agitator 120 to the sub-tank 70. The developer accommodating capacity of the sub-tank 70 in this exemplary embodiment is smaller than that of the sub-tank 70 in the first exemplary embodiment.

Providing the sub-tank 70 with one sub-tank agitator 119 and arranging the developer feed outlet 70*a* in a position overlapping the projection face of the sub-tank agitator 119 to the sub-tank 70 in this way makes it possible to prevent toner, even if it is a highly fluid one, from being excessively supplied to the main tank 68 by the sub-tank agitator 119.

Regarding the second exemplary embodiment of the invention, the same constituent parts as in the first embodiment are assigned the same reference numerals in the drawing, and their description is dispensed with.

As hitherto described, the present invention can be effectively applied to process cartridges and image forming apparatuses which require smooth conveyance of the developer.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A process cartridge that is detachably fitted to an image forming apparatus body and has an image holder and a developing device that makes a latent image formed on the image holder visible and has a developer accommodating space, comprising:

a first developer accommodating section and a second developer accommodating section provided by splitting the developer accommodating space;

a developer passage that connects a developer feed inlet opening to the first developer accommodating section and a developer feed outlet opening to the second developer accommodating section;

a first stirring/conveying member that is rotatably disposed in the first developer accommodating section and stirs/conveys the developer within the first developer accommodating section; and at least two second stirring/conveying members that are rotatably disposed in the second developer accommodating section and stir/convey the developer within the second developer accommodating section, wherein the developer feed outlet is arranged immediately under a projection face of one second stirring/conveying member out of the at least two second stirring/conveying members when the projection face is in a vertical direction.

2. The process cartridge according to claim 1, comprising two of the first stirring/conveying members and two of the second stirring/conveying members, a center distance of the two second stirring/conveying members being disposed shorter than a center distance of the two first stirring/conveying members.

3. The process cartridge according to claim 2, wherein a width of the developer feed outlet is disposed to be smaller than the center distance of the two first stirring/conveying members.

4. The process cartridge according to claim 2, wherein a width of the developer feed inlet is disposed to be equal to or greater than a width of the developer feed outlet.

5. The process cartridge according to claim 1, wherein at least part of the second stirring/conveying members is disposed opposite the developer feed outlet.

6. The process cartridge according to claim 1, wherein the developer passage is provided with an intercepting member is formed to intercept connection between the first developer accommodating section and the second developer accommodating section.

7. An image forming apparatus having a process cartridge according to claim 1.

8. A process cartridge that is detachably fitted to an image forming apparatus body and has image holder and a developing device that makes a latent image formed on the image holder visible and has a developer accommodating space, comprising:

a first developer accommodating section and a second developer accommodating section provided by splitting the developer accommodating space;

a developer passage that connects a developer feed inlet opening to the first developer accommodating section and a developer feed outlet opening to the second developer accommodating section;

at least two first stirring/conveying members that are rotatably disposed in the first developer accommodating section and stir/convey the developer within the first developer accommodating section; and a second stirring/conveying member that is rotatably disposed in the second developer accommodating section and stirs/conveys the developer within the second developer accommodating section, wherein the developer feed inlet is arranged symmetrically between the at least two first stirring/conveying members, wherein each of the at least two first stirring/conveying members comprises a stirring/conveying film which rotates about a rotation shaft, and wherein an extending direction of the stirring/conveying film of one of the at least two first stirring/conveying members forms an angle of approximately 90 degrees with an extending direction of the stirring/conveying film of another of the at least two first stirring/conveying members.

9. The process cartridge according to claim 8, wherein the developer feed outlet is arranged in a position overlapping a projection face of the second stirring/conveying member to the second developer accommodating section.

10. The process cartridge according to claim 8, comprising a plurality of the second stirring/conveying members, the developer feed outlet being arranged in a position overlapping a projection face of one of the plurality of second stirring/conveying members to the second developer accommodating section.

11. The process cartridge according to claim 8, comprising two of the first stirring/conveying members and two of the second stirring/conveying members, a center distance of the two second stirring/conveying members being disposed shorter than a center distance of the two first stirring/conveying members.

12. The process cartridge according to claim 11, wherein a width of the developer feed outlet is disposed to be smaller than the center distance of the two first stirring/conveying members.

13. The process cartridge according to claim 11, wherein a width of the developer feed inlet is disposed to be equal to or greater than a width of the developer feed outlet.

14. The process cartridge according to claim 8, wherein the developer passage is formed of an elastic member.

15. An image forming apparatus having a process cartridge according to claim 8.

16. The process cartridge according to claim 8, wherein the developer feed inlet is arranged symmetrically between the at least two first stirring/conveying members with respect to a plan view of the process cartridge.

17. A process cartridge that is detachably fitted to an image forming apparatus body and has an image holder and a developing device that makes a latent image formed on the image holder visible and has a developer accommodating space, comprising:

a first developer accommodating section and a second developer accommodating section provided by splitting the developer accommodating space;

a developer passage that connects a developer feed inlet opening to the first developer accommodating section and a developer feed outlet opening to the second developer accommodating section;

a first stirring/conveying member that is rotatably disposed in the first developer accommodating section and stirs/conveys the developer within the first developer accommodating section; and at least two second stirring/conveying members that are rotatably disposed in the second developer accommodating section and stir/convey the developer within the second developer accommodating section, wherein the developer feed outlet is arranged in a position overlapping a projection face of one second stirring/conveying member out of the at least two second stirring/conveying members to the second developer accommodating section, wherein at least part of the second stirring/conveying members is disposed opposite the developer feed outlet, and wherein each of the second stirring/conveying members has a rotation shaft rotatably disposed in the second developer accommodating section and a sheet-shaped film member fixed to the rotation shaft, the film member having at least two cuts in a position opposite the developer feed outlet of the second stirring/conveying member and parts demarcated by the cuts entering into the developer feed outlet.

18. A process cartridge that is detachably fitted to an image forming apparatus body and has an image holder and a developing device that makes a latent image formed on the image holder visible and has a developer accommodating space, comprising:

a first developer accommodating section and a second developer accommodating section provided by splitting the developer accommodating space;

a developer passage that connects a developer feed inlet opening to the first developer accommodating section and a developer feed outlet opening to the second developer accommodating section;

at least two first stirring/conveying members that are rotatably disposed in the first developer accommodating section and stir/convey the developer within the first developer accommodating section; and a second stirring/conveying member that is rotatably disposed in the second developer accommodating section and stirs/conveys the developer within the second developer accommodating section, wherein the developer feed inlet is arranged between the at least two first stirring/conveying members, and wherein the first developer accommodating section has a developer discharge port through which the developer in the first developer accommodating section is discharged, the discharge port is disposed near an end of one of the first stirring/conveying members in an axial direction, and the developer feed inlet is disposed near an end of another of the first stirring/conveying members in the axial direction.

19. A process cartridge that is detachably fitted to an image forming apparatus body and has an image holder and a developing device that makes a latent image formed on the image holder visible and has a developer accommodating space, comprising:

a first developer accommodating section and a second developer accommodating section provided by splitting the developer accommodating space;

a developer passage that connects a developer feed inlet opening to the first developer accommodating section and a developer feed outlet opening to the second developer accommodating section;

a first stirring/conveying member that is rotatably disposed in the first developer accommodating section and stirs/conveys the developer within the first developer accommodating section;

at least two second stirring/conveying members that are rotatably disposed in the second developer accommodating section and stir/convey the developer within the second developer accommodating section; and a drive transmission device that transmits driving force to the first stirring/conveying member and the second stirring/conveying members so as to differentiate the timing at which the second stirring/conveying members come to oppose the developer feed outlet and the timing at which the first stirring/conveying member come to overlap the projection face of the developer feed inlet, wherein the developer feed outlet is arranged in a position overlapping a projection face of one second stirring/conveying member out of the at least two second stirring/conveying members to the second developer accommodating section.

20. A process cartridge that is detachably fitted to an image forming apparatus body and has an image holder and a developing device that makes a latent image formed on the image holder visible and has a developer accommodating space, comprising:

a first developer accommodating section and a second developer accommodating section provided by splitting the developer accommodating space;

a developer passage that connects a developer feed inlet opening to the first developer accommodating section and a developer feed outlet opening to the second developer accommodating section;

at least two first stirring/conveying members that are rotatably disposed in the first developer accommodating section and stir/convey the developer within the first developer accommodating section;

a second stirring/conveying member that is rotatably disposed in the second developer accommodating section and stirs/conveys the developer within the second developer accommodating section; and a drive transmission device that transmits driving force to the first stirring/conveying members and the second stirring/conveying member so as to differentiate the timing at which the second stirring/conveying member comes to oppose the developer feed outlet and the timing at which the first stirring/conveying members come to overlap a projection face of the developer feed inlet, wherein the developer feed inlet is arranged between the at least two first stirring/conveying members.

21. A method of assembling a process cartridge that is detachably fitted to an image forming apparatus body and has an image holder and a developing device that makes a latent image formed on the image holder visible and has a developer accommodating space, the process cartridge having a first developer accommodating section and a second developer accommodating section provided by splitting the developer accommodating space; a developer passage that connects a developer feed inlet opening to the first developer accommodating section and a developer feed outlet opening to the second developer accommodating section; at least two first stirring/conveying members that are rotatably disposed in the first developer accommodating section and stir/convey the developer within the first developer accommodating section; and a second stirring/conveying member that is rotatably disposed in the second developer accommodating section and stirs/conveys the developer within the second developer accommodating section, wherein the developer feed inlet is arranged between the at least two first stirring/conveying members, the method comprising fitting the first stirring/conveying members and the second stirring/conveying member so as to differentiate the timing at which the second stirring conveying member comes to oppose the developer feed outlet and the timing at which the first stirring/conveying members come to overlap a projection face of the developer feed inlet.

* * * * *